US010093515B2

(12) United States Patent
Shiraishi et al.

(10) Patent No.: US 10,093,515 B2
(45) Date of Patent: Oct. 9, 2018

(54) ELEVATOR APPARATUS

(71) Applicant: MITSUBISHI ELECTRIC CORPORATION, Chiyoda-ku (JP)

(72) Inventors: Naohiro Shiraishi, Chiyoda-ku (JP); Seiji Watanabe, Chiyoda-ku (JP); Kotaro Fukui, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 15/122,004

(22) PCT Filed: Apr. 9, 2014

(86) PCT No.: PCT/JP2014/060291
§ 371 (c)(1),
(2) Date: Aug. 26, 2016

(87) PCT Pub. No.: WO2015/155854
PCT Pub. Date: Oct. 15, 2015

(65) Prior Publication Data
US 2017/0008732 A1 Jan. 12, 2017

(51) Int. Cl.
*B66B 11/08* (2006.01)
*B66B 5/12* (2006.01)
(Continued)

(52) U.S. Cl.
CPC ..... *B66B 5/12* (2013.01); *B66B 5/0031* (2013.01); *B66B 5/04* (2013.01); *B66B 5/044* (2013.01);
(Continued)

(58) Field of Classification Search
CPC ..... B66B 5/12; B66B 5/0031; B66B 5/04; B66B 5/044; B66B 5/18; B66B 5/28; B66B 7/10; B66B 9/00
(Continued)

(56) References Cited

U.S. PATENT DOCUMENTS

2007/0221453 A1 9/2007 Windlin et al.
2012/0105242 A1* 5/2012 Pereira ..... B66B 5/12 340/668
(Continued)

FOREIGN PATENT DOCUMENTS

CN 1862490 A 12/2006
CN 10326118 A 12/2008
(Continued)

OTHER PUBLICATIONS

International Search Report dated May 27, 2014 in PCT/JP2014/060291 filed Apr. 9, 2014.
(Continued)

*Primary Examiner* — Jeffrey Donels
(74) *Attorney, Agent, or Firm* — Xsensus, LLP

(57) ABSTRACT

In an elevator apparatus, a safety device that makes a car perform emergency stopping is mounted to the car. A rope is installed in a loop inside a hoistway. The rope is connected to the car. A tensioning sheave around which the rope is wound is disposed in a lower portion of the hoistway. A tensioning sheave displacement detecting portion detects downward displacement of the tensioning sheave that accompanies dropping of the car due to breakage of the suspending body and activates the safety device.

6 Claims, 11 Drawing Sheets

(51) Int. Cl.

| | |
|---|---|
| ***B66B 5/00*** | (2006.01) |
| ***B66B 5/04*** | (2006.01) |
| ***B66B 5/28*** | (2006.01) |
| ***B66B 7/10*** | (2006.01) |
| ***B66B 9/00*** | (2006.01) |
| ***B66B 5/18*** | (2006.01) |

(52) U.S. Cl.
CPC ..... *B66B 5/18* (2013.01); *B66B 5/28* (2013.01); *B66B 7/10* (2013.01); *B66B 9/00* (2013.01)

(58) Field of Classification Search
USPC ..... 187/264
See application file for complete search history.

(56) References Cited

U.S. PATENT DOCUMENTS

2012/0205198 A1* 8/2012 Okada ..... B66B 5/18 187/350
2012/0292136 A1* 11/2012 Washio ..... B66B 5/0031 187/393

FOREIGN PATENT DOCUMENTS

| | | | |
|---|---|---|---|
| EP | 1 849 734 | A1 | 10/2007 |
| EP | 1 900 673 | A1 | 3/2008 |
| JP | 47-37781 | | 11/1972 |
| JP | 5-338958 | A | 12/1993 |
| JP | 9-278307 | | 10/1997 |
| JP | 2003-104646 | A | 4/2003 |
| KR | 10-2007-0031849 | A | 3/2007 |
| KR | 10-2012-0060237 | A | 6/2012 |
| WO | 2005/021413 | A1 | 3/2005 |
| WO | WO 2006/022015 | A1 | 3/2006 |
| WO | WO 2007/077828 | A1 | 7/2007 |
| WO | 2009/093330 | A1 | 7/2009 |
| WO | WO 2011/052053 | A1 | 5/2011 |
| WO | 2013/190869 | A1 | 12/2013 |

OTHER PUBLICATIONS

Combined Chinese Office Action and Search Report dated Feb. 24, 2018 in Chinese Patent Application No. 201480077661.2 (with English translation), citing documents AO and AP therein, 13 pages.
Korean Office Action dated Mar. 21, 2018 in Korean Patent Application No. 10-2016-7027895 (with English translation), citing documents AS, AT and AU therein.

* cited by examiner

ELEVATOR APPARATUS

TECHNICAL FIELD

The present invention relates to an elevator apparatus in which a car is made to perform emergency stopping using a safety device if a suspending body that suspends the car breaks.

BACKGROUND ART

In conventional elevator apparatus speed governors, a first overspeed Vos (an activating speed of an operation stopping switch) is set to approximately 1.3 times a rated speed Vr, and a second overspeed Vtr (a safety tripping speed) is set to approximately 1.4 times the rated speed Vr. If it is detected that the car has exceeded the rated speed and reached the first overspeed Vos, due to an abnormality in the controlling apparatus, for example, power supply to a hoisting machine is interrupted to stop the car urgently. If the car is falling due to breakage of a main rope, etc., the second overspeed Vtr is detected by the speed governor, and a safety device is activated to make the car perform emergency stopping.

However, if the car is positioned in a vicinity of a terminal floor of a hoistway, the car may reach a bottom portion of the hoistway before the car speed increases to the first overspeed Vos and the second overspeed Vtr, and in that case the car is decelerated and stopped by a buffer. For this purpose, the buffer requires a longer buffering stroke as the speed that must be decelerated increases, and the length of the buffer is determined by the first overspeed Vos and the second overspeed Vtr.

In answer to that, a method has also been proposed in which a car position switch is disposed in a vicinity of the terminal floor to detect an abnormality and shut off the power supply to the hoisting machine at a terminal overspeed Vts that is lower than the first overspeed Vos when the car position switch is operated.

Thus, provided that the main rope is still connected to the car, the car speed will not exceed the terminal overspeed Vts. If, on the other hand, the main rope breaks when the car is positioned in a vicinity of a lower terminal floor of the hoistway, it is not possible to brake the car using the hoisting machine even if the terminal overspeed Vts is detected.

In that case, if Ts is the time from when the main rope breaks until the car collides with the buffer, then the impact speed Vs is:

$$Vs=Vts+g\times Ts.$$

If this impact speed Vs is lower than the second overspeed Vtr of the speed governor, then it is possible to shorten the buffering stroke of the buffer proportionately.

However, in recent years, there is demand for additional space saving and cost saving, and there has been demand for buffer dimensions to be shortened further, and speed governors have been proposed in which the first overspeed Vos and the second overspeed Vtr are reduced in the vicinity of terminal floors (see Patent Literature 1 and 2, for example).

CITATION LIST

Patent Literature

[Patent Literature 1]
Japanese Patent Laid-Open No. 2003-104646 (Gazette)
[Patent Literature 2]
International Publication No. WO 2009/093330

SUMMARY OF THE INVENTION

Problem to be Solved by the Invention

In conventional elevator apparatuses such as those described above, the construction of the speed governors becomes complicated in order to lower the first overspeed Vos and the second overspeed Vtr in the vicinity of the terminal floors.

The present invention aims to solve the above problems and an object of the present invention is to provide an elevator apparatus that enables space saving in a hoistway by a simple configuration.

Means for Solving the Problem

An elevator apparatus according to the present invention includes: a car that ascends and descends inside a hoistway; a suspending body that suspends the car; a hoisting machine that raises and lowers the car; a safety device that is mounted to the car, and that makes the car perform emergency stopping; a car buffer that alleviates mechanical shock from a collision of the car into a bottom portion of the hoistway; a rope that is installed in a loop inside the hoistway, and that is connected to the car; a tensioning sheave that is disposed in a lower portion of the hoistway, and around which the rope is wound; and a tensioning sheave displacement detecting portion that detects downward displacement of the tensioning sheave that accompanies dropping of the car due to breakage of the suspending body, and that activates the safety device.

Effects of the Invention

In an elevator apparatus according to the present invention, because the tensioning sheave displacement detecting portion detects downward displacement of the tensioning sheave that accompanies dropping of the car due to breakage of the suspending body and activates the safety device, the buffering stroke of the buffer can be shortened by a simple configuration, enabling space saving to be achieved in the hoistway.

DESCRIPTION OF EMBODIMENTS

Embodiments for implementing the present invention will now be explained with reference to the drawings.

Embodiment 1

Figure 1:
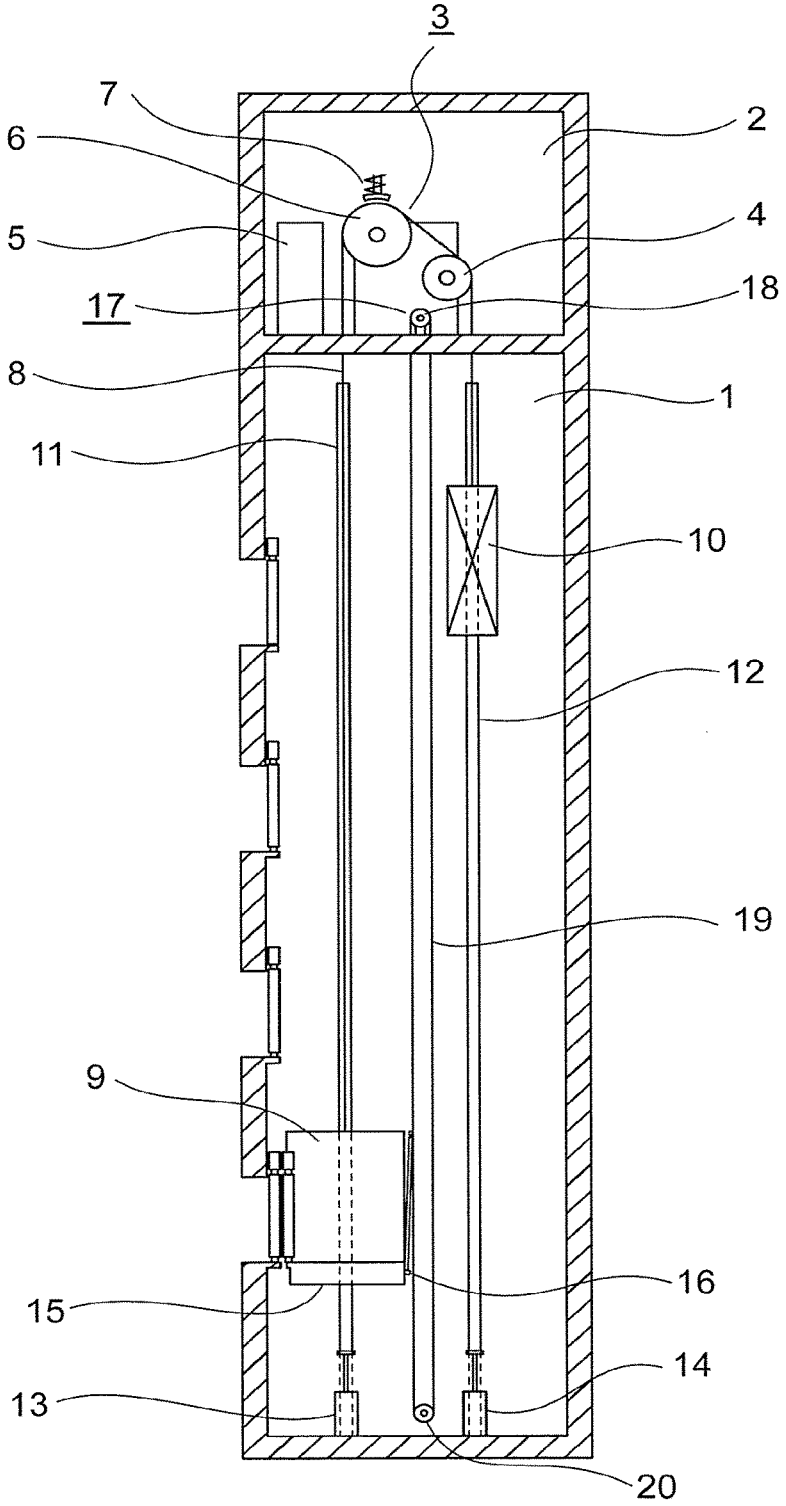
FIG. 1 is a configuration diagram that shows an elevator apparatus according to Embodiment 1 of the present invention.

FIG. 1 is a configuration diagram that shows an elevator according to Embodiment 1 of the present invention. In the figure, a machine room 2 is disposed in an upper portion of a hoistway 1. Installed in the machine room 2 are: a hoisting machine (a driving apparatus) 3; a deflecting sheave 4; and a controlling apparatus 5. The hoisting machine 3 has: a driving sheave 6; a hoisting machine motor (not shown) that rotates the driving sheave 6; and a hoisting machine brake 7 that brakes rotation of the driving sheave 6.

The hoisting machine brake 7 has: a brake wheel (a drum or a disk) that is coupled coaxially to the driving sheave 6; a brake shoe that is placed in contact with and separated from the brake wheel; a brake spring that presses the brake shoe against the brake wheel to apply a braking force; and an electromagnet that separates the brake shoe from the brake wheel in opposition to the brake spring to release the braking force.

A suspending body 8 is wound around the driving sheave 6 and the deflecting sheave 4. A plurality of ropes or a plurality of belts are used as the suspending body 8. A car 9 is connected to a first end portion of the suspending body 8. A counterweight 10 is connected to a second end portion of the suspending body 8.

The car 9 and the counterweight 10 are suspended inside the hoistway 1 by the suspending body 8, and are raised and lowered inside the hoistway 1 by a driving force from the hoisting machine 3. The controlling apparatus 5 raises and lowers the car 9 at a set speed by controlling rotation of the hoisting machine 3.

A pair of car guide rails 11 that guide raising and lowering of the car 9 and a pair of counterweight guide rails 12 that guide raising and lowering of the counterweight 10 are installed inside the hoistway 1. A car buffer 13 and a counterweight buffer 14 are installed on a bottom portion of the hoistway 1. The car buffer 13 alleviates mechanical shock of a collision of the car 9 into the bottom portion of the hoistway 1. The counterweight buffer 14 similarly alleviates mechanical shock of a collision of the counterweight 10 into the bottom portion of the hoistway 1.

A safety device 15 that makes the car 9 perform emergency stopping by gripping a car guide rail 11 is mounted onto a lower portion of the car 9. An activating lever 16 that activates the safety device 15 is disposed on the safety device 15.

A speed governor 17 that monitors for overspeed traveling of the car 9 is disposed in the machine room 2. The speed governor 17 has: a speed governor sheave 18; an overspeed detecting switch; a rope catch, etc. A speed governor rope 19 is wound around the speed governor sheave 18.

The speed governor rope 19 is installed in a loop inside the hoistway 1, and is connected to the activating lever 16. In other words, the speed governor rope 19 is connected to the car 9 by means of the safety device 15. The speed governor rope 19 is wound around a tensioning sheave 20 that is disposed in a lower portion of the hoistway 1. The speed governor rope 19 moves cyclically when the car 9 ascends and descends, rotating the speed governor sheave 18 at a rotational speed that corresponds to the traveling speed of the car 9.

The traveling speed of the car 9 reaching the overspeeds is detected mechanically by the speed governor 17. A first overspeed Vos that is higher than a rated speed Vr and a second overspeed Vtr that is higher than the first overspeed are set as detected overspeeds.

The overspeed detecting switch is operated if the traveling speed of the car 9 reaches the first overspeed Vos. Power supply to the hoisting machine 3 is interrupted thereby to stop the car 9 urgently.

If the descent speed of the car 9 reaches the second overspeed Vtr, the speed governor rope 19 is gripped by the rope catch, stopping the cycling of the speed governor rope 19. The activating lever 16 is operated thereby, tripping the safety device 15 to make the car 9 to perform emergency stopping.

Figure 2:
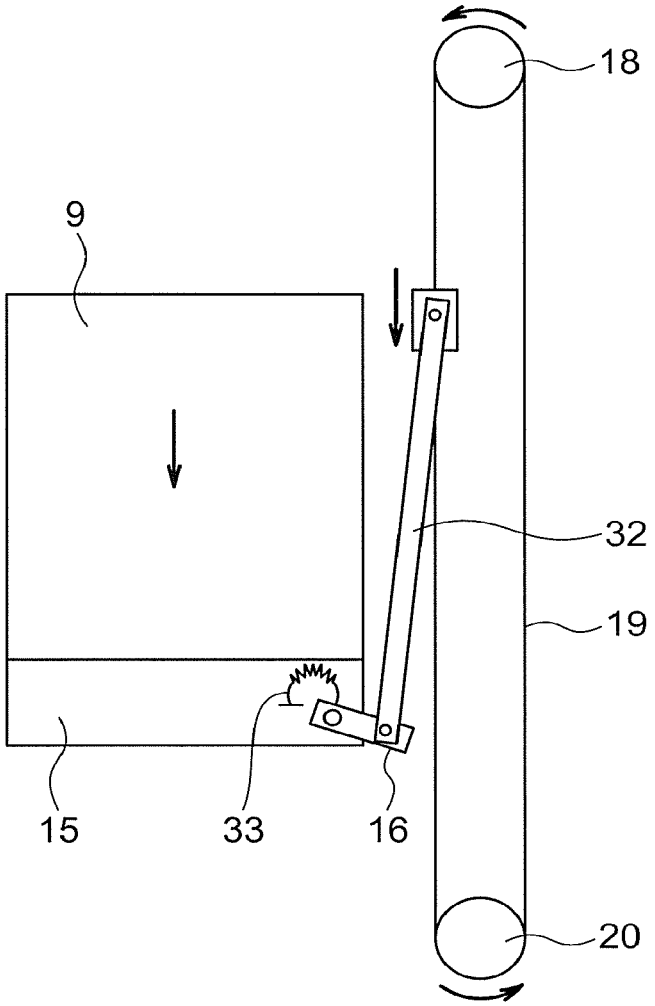
FIG. 2 is a configuration diagram that schematically shows part of the elevator apparatus in FIG. 1.

FIG. 2 is a configuration diagram that schematically shows part of the elevator apparatus in FIG. 1. The activating lever 16 is connected to the speed governor rope 19 by means of a lifting rod 32. A force in an opposite direction to the direction that actuates the safety device 15, such as a downward pressing force from a resisting spring 33, for example, is applied to the activating lever 16 and the lifting rod 32.

Figure 3:
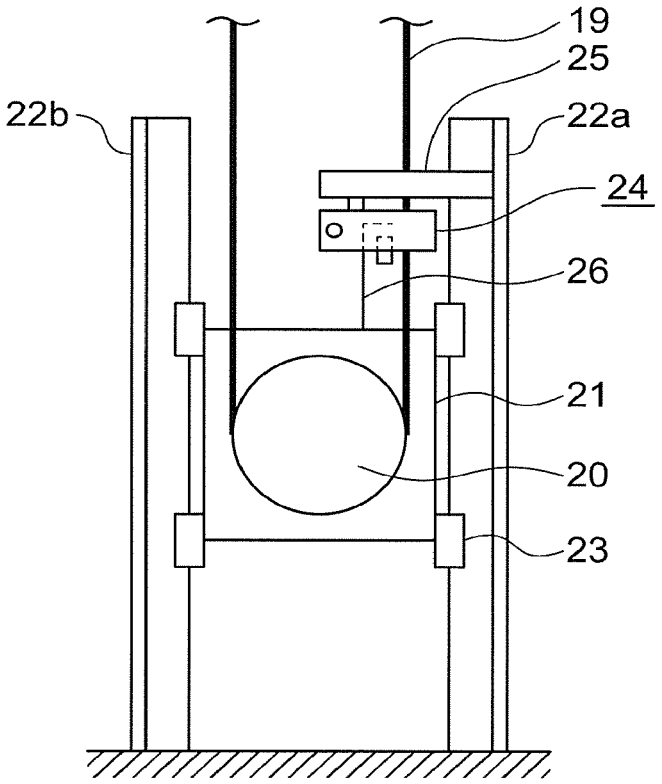
FIG. 3 is a front elevation that shows a tensioning sheave from FIG. 1 and portions in a vicinity thereof.

FIG. 3 is a front elevation that shows a tensioning sheave from FIG. 1 and portions in a vicinity thereof. The tensioning sheave 20 is rotatably held by the tensioning sheave frame 21. The tensioning sheave 20 is vertically displaceable together with the tensioning sheave frame 21 to add tension to the speed governor rope 19.

First and second tensioning sheave rails 22*a* and 22*b* that guide vertical movement of the tensioning sheave frame 21 are installed in a bottom portion inside the hoistway 1. A plurality of guiding members 23 that slide along the tensioning sheave rails 22*a* and 22*b* are fixed to the tensioning sheave frame 21.

A tensioning sheave displacement detecting portion 24 is disposed between the first tensioning sheave rail 22*a* and the tensioning sheave frame 21. The tensioning sheave displacement detecting portion 24 detects downward displacement of the tensioning sheave 20 that accompanies dropping of the car 9 due to breakage of the suspending body 8 and activates the safety device 15. The tensioning sheave displacement detecting portion 24 according to Embodiment 1 stops movement of the speed governor rope 19 to activate the safety device 15 if the tensioning sheave 20 descends greater than or equal to a predetermined distance from a normal position (a position when the suspending body 8 is not broken).

The tensioning sheave displacement detecting portion 24 has: a rope gripping mechanism 25 that is fixed inside the hoistway 1; and an L-shaped switch member 26 that is connected to the tensioning sheave 20. The rope gripping mechanism 25 is mounted to the first tensioning sheave rail 22*a*. The switch member 26 is mounted to an upper portion of the tensioning sheave frame 21. The rope gripping mechanism 25 grips the speed governor rope 19 to activate the safety device 15 when the switch member 26 is displaced downward and operates the rope gripping mechanism 25 mechanically due to the downward displacement of the tensioning sheave 20 that accompanies dropping of the car 9 due to breakage of the suspending body 8.

Figure 4:
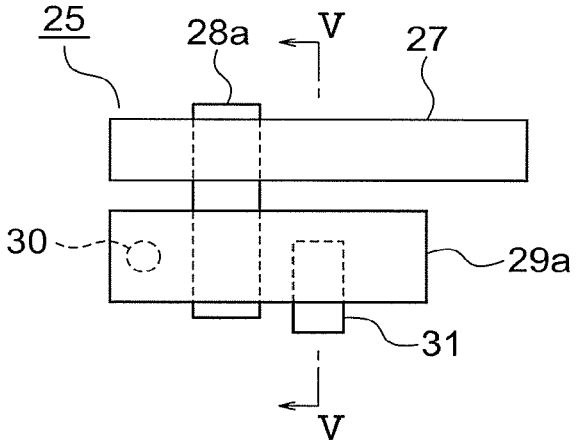
FIG. 4 is a side elevation that shows a rope gripping mechanism from FIG. 3.
Figure 5:
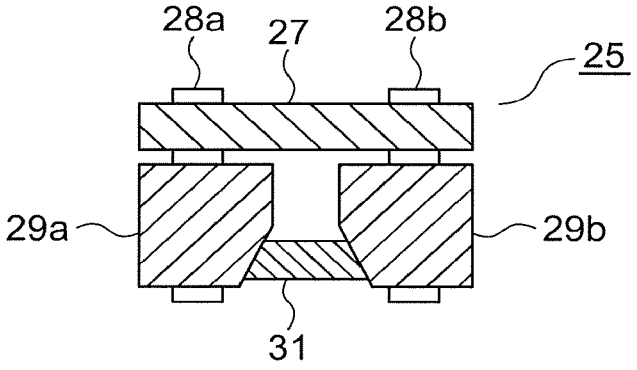
FIG. 5 is a cross section that is taken along Line V-V in FIG. 4.
Figure 6:
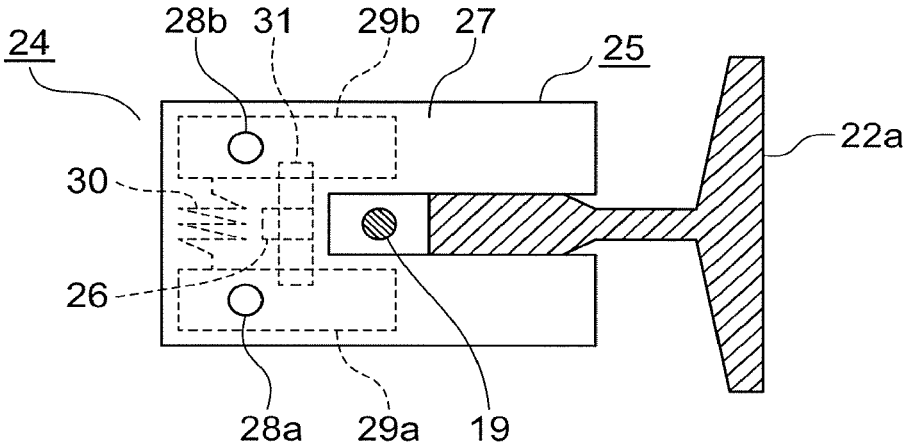
FIG. 6 is a plan that shows a tensioning sheave displacement detecting portion from FIG. 3.

FIG. 4 is a side elevation that shows a rope gripping mechanism 25 from FIG. 3, FIG. 5 is a cross section that is taken along Line V-V in FIG. 4, FIG. 6 is a plan that shows a tensioning sheave displacement detecting portion 24 from FIG. 3. The rope gripping mechanism 25 has: a rail holding member 27; first and second pins 28*a* and 28*b*; first and second gripping members 29*a* and 29*b*; a spring 30; and a wedge 31.

The rail holding member 27 is fixed to the first tensioning sheave rail 22*a* above the tensioning sheave 20. The speed governor rope 19 passes through a space that is formed between the first tensioning sheave rail 22*a* and the rail holding member 27.

The first and second pins 28*a* and 28*b* are disposed on the rail holding member 27 so as to be parallel to the speed governor rope 19. The first gripping member 29*a* is able to rotate around the first pin 28*a*. The second gripping member 29*b* is able to rotate around the second pin 28*b*.

The gripping members 29*a* and 29*b* each include: a first end portion that faces the speed governor rope 19; and a second end portion that is positioned on an opposite side from the first end portion. The spring 30 is disposed between the second end portions of the gripping members 29*a* and 29*b*. Furthermore, the spring 30 pushes the second end portions in directions in which the first end portions grip the speed governor rope 19.

The wedge 31, as shown in FIG. 5, is interposed between the gripping members 29*a* and 29*b* so as to hold the first end portions of the gripping members 29*a* and 29*b* at positions that are separated from the speed governor rope 19 in opposition to the spring 30.

Figure 7:
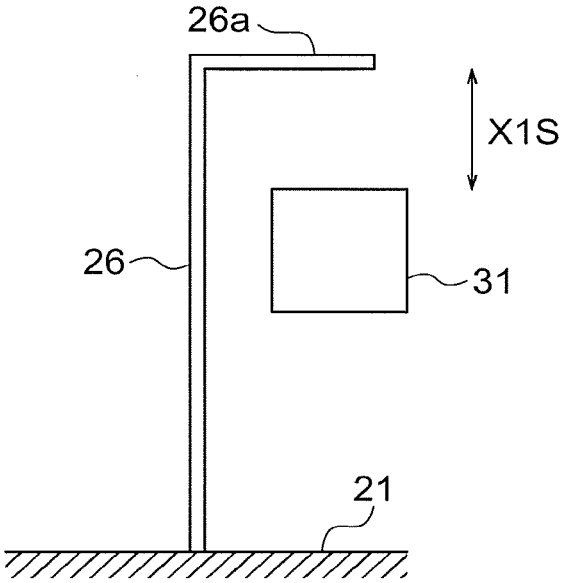
FIG. 7 is a side elevation that shows a relationship between a switch member and a wedge from FIG. 6.

FIG. 7 is a side elevation that shows a relationship between the switch member 26 and the wedge 31 from FIG. 6. The switch member 26 has a horizontal contacting portion 26*a* that faces an upper surface of the wedge 31. If the tensioning sheave 20 descends greater than or equal to a predetermined distance from the normal position due to breakage of the suspending body 8, the contacting portions 26*a* contacts the upper surface of the wedge 31, and the wedge 31 is pushed downward and dislodges from between the gripping members 29*a* and 29*b*.

When the wedge 31 dislodges from between the gripping members 29*a* and 29*b*, the spring 30 expands, and the speed governor rope 19 is gripped by the first end portions of the gripping members 29*a* and 29*b*. Movement of the speed governor rope 19 is stopped thereby, activating the safety device 15.

Now, if the hoisting zone of the car 9 is long (100 m or more, for example), then the length of the speed governor rope 19 is longer, and a model in which the total mass of the governor mechanism, including the speed governor sheave 18, the speed governor rope 19, and the tensioning sheave 20, moves as one body no longer holds. Consequently, if the hoisting zone is long, it is necessary to consider a vibrational model that has three degrees of freedom, as shown in FIG. 8.

Figure 8:
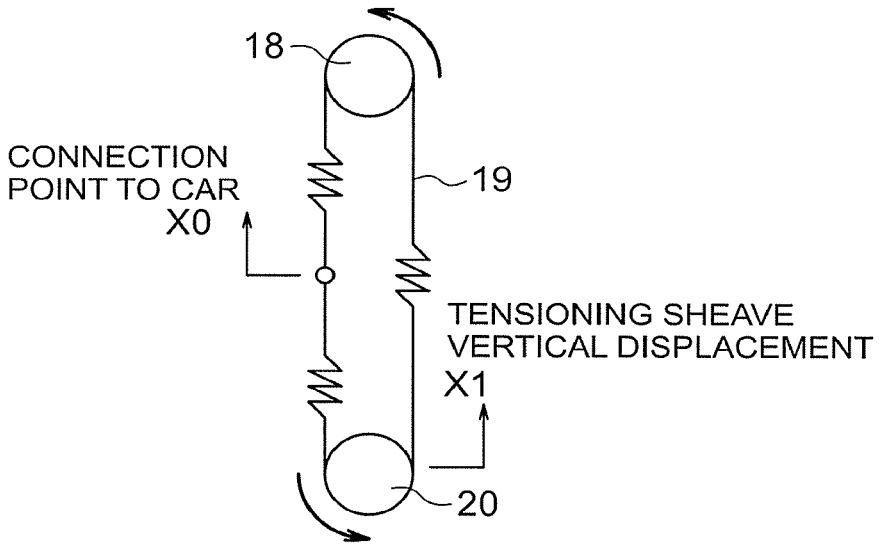
FIG. 8 is an explanatory diagram that shows a simple model of a governor mechanism from FIG. 2 that has three degrees of freedom.
Figure 9:
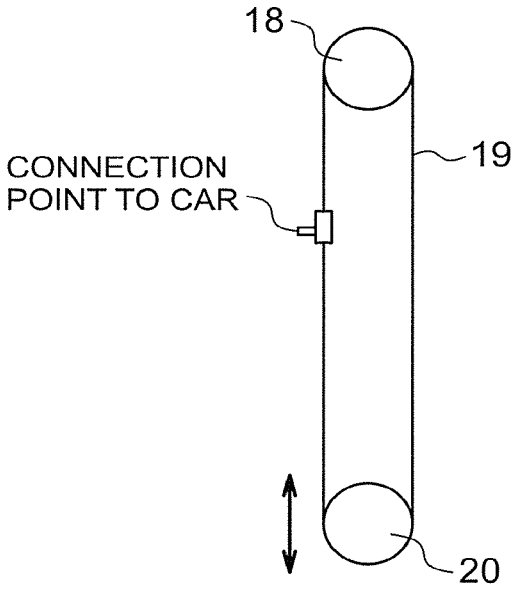
FIG. 9 is an explanatory diagram that shows a first mode of vibration in the simple model in FIG. 8.
Figure 10:
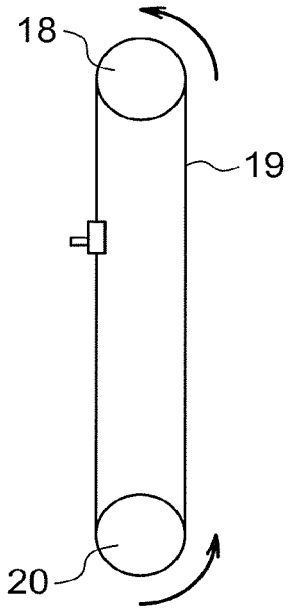
FIG. 10 is an explanatory diagram that shows a second mode of vibration in the simple model in FIG. 8.
Figure 11:
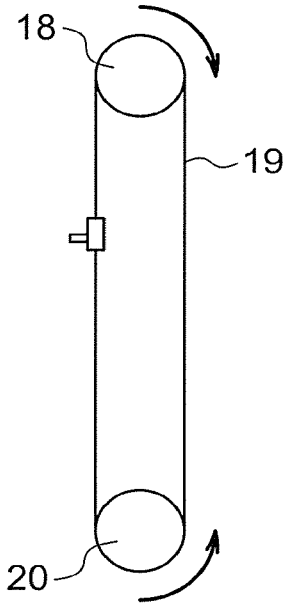
FIG. 11 is an explanatory diagram that shows a third mode of vibration in the simple model in FIG. 8.

FIG. 9 is an explanatory diagram that shows a first mode of vibration (vertical vibration of the tensioning sheave 20) in the simple model in FIG. 8, FIG. 10 is an explanatory diagram that shows a second mode of vibration (same-phase vibration of the speed governor sheave 18 and the tensioning sheave 20) in the simple model in FIG. 5, and FIG. 11 is an explanatory diagram that shows a third mode of vibration (opposite-phase vibration of the speed governor sheave 18 and the tensioning sheave 20) in the simple model in FIG. 8.

When acceleration arises in the car 9, the tensioning sheave 20 displaces vertically due to the first mode of vibration of the governor mechanism. In particular, if a constant acceleration $d^2x_o/dt^2$ is applied downward, the amount of descent $x_1$ of the tensioning sheave 20 is given by the following expressions:

$$x_1 = \frac{(1-\alpha)M\ddot{x}_0}{K} \qquad (1)$$

$$\ddot{x}_0 = d^2x_0/dt^2$$

Here, M is the inertial mass of the governor mechanism, and has a fixed value. K is rigidity that is determined by the speed governor rope 19, and also has a fixed value. Furthermore, a is a variable that changes depending on car position, and has a value between zero and one, zero representing the lowermost floor, and one the uppermost floor.

Thus, if the suspending body 8 breaks when the car position is in the vicinity of the lowermost floor (a has a value that is close to zero), the amount of descent of the tensioning sheave 20 is given by the following expression:

$$x_{1g}=MG/K \qquad (2)$$

Moreover, G is gravitational acceleration.

If the car 9 is stopped suddenly using an emergency brake (the hoisting machine brake 7) when the car position is in the vicinity of the lowermost floor, on the other hand, then the deceleration rate of the car 9 due to the emergency brake is approximately 0.3 G. Because of that, the amount of descent of the tensioning sheave 20 in that case is given by the following expression:

$$x_{1b}=\beta x_{1g} \qquad (3)$$

where β is approximately 0.3.

Figure 12:
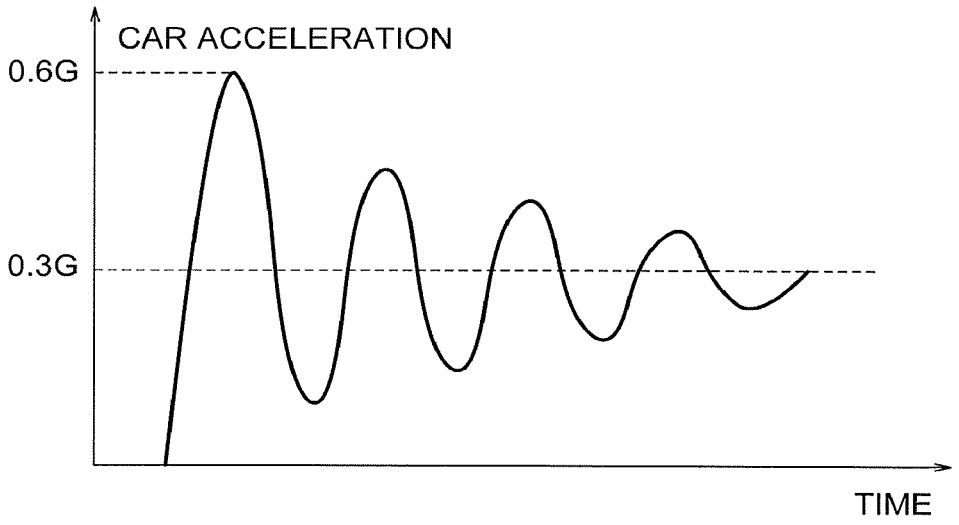
FIG. 12 is a graph that shows time variation in car acceleration when a car from FIG. 1 is stopped by an emergency brake.

If the average deceleration of the car 9 due to emergency braking is 0.3 G, then, as shown in FIG. 12, the maximum deceleration of the car 9 due to vibration is twice the average deceleration, i.e., 0.6 G. Thus, a deceleration rate of the car 9 that is over 0.6 G and less than or equal to 1 G is made an acceptance criterion for breakage of the suspending body 8. A judgment criterion of 0.8 G is obtained from the following expression, for example:

$$\ddot{x}_0 = \frac{0.6+1.0}{2}G = 0.8G$$

In that case, from Expression (1), $x_{1s}=0.8x_{1g}$.

Consequently, a switching distance $x_{1s}$ in FIG. 7 is set to approximately $0.8x_{1g}$. The speed governor rope 19 is thereby gripped during descent of the tensioning sheave 20 due to breakage of the suspending body 8, activating the safety device 15. In other words, if the car 9 accelerates downward at 1 G due to breakage of the suspending body 8, then the tensioning sheave 20 descends by $x_{1g}$, as indicated by Expression (2). At this point, because the switching distance $x_{1s}$ is shorter than $x_{1g}$, the switch member 26 pushes the wedge 31 downward, the wedge 31 dislodges from between the gripping members 29*a* and 29*b*, and the speed governor rope 19 is gripped by the gripping members 29*a* and 29*b*.

During emergency brake operation, on the other hand, because the tensioning sheave 20 does not descend up to $0.8x_{1g}$, the speed governor rope 19 is not gripped, and the safety device 15 is not activated.

If the car 9 is positioned at an intermediate floor or the uppermost floor, then the amount of displacement of the tensioning sheave 20 is reduced because a approaches one, as indicated by Expression (1). Because of that, malfunction of the safety device 15 due to emergency brake operation is less likely to occur at intermediate floors and the uppermost floor than in a vicinity of the lowermost floor.

Similarly, if the car 9 is positioned at an intermediate floor or the uppermost floor, then the tensioning sheave displacement detecting portion 24 also ceases to operate for breakage of the suspending body 8. However, in that case, there is no problem because the car 9 can be stopped by normal detection of overspeed by the speed governor 17.

In an elevator apparatus of this kind, because the tensioning sheave displacement detecting portion 24 detects downward displacement of the tensioning sheave 20 that accompanies dropping of the car 9 due to breakage of the suspending body 8, and activates the safety device 15, the buffering stroke of the buffer 13 can be shortened by a simple configuration, enabling space saving to be achieved in the hoistway 1.

Because breakage of the suspending body 8 is detected using an existing speed governor rope 19 and tensioning sheave 20, the configuration can be simplified further.

In addition, because a switch member 26 that moves vertically together with the tensioning sheave 20, and a rope gripping mechanism 25 that is actuated mechanically by the switch member 26 to grip the speed governor rope 19, are used, the safety device 15 can be activated more reliably by a simple configuration.

Furthermore, the judgment criterion for breakage of the suspending body 8 can be adjusted simply by adjusting the switching distance.

Embodiment 2

Figure 13:
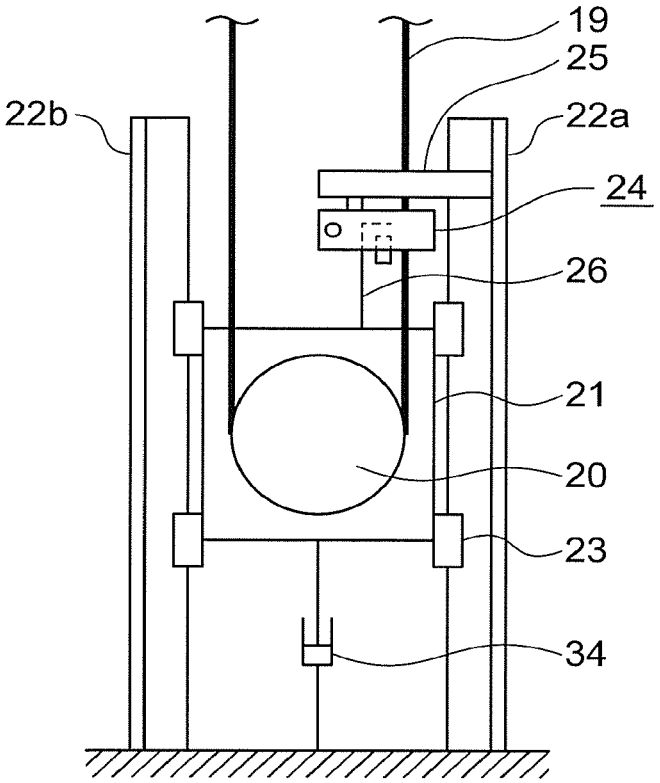
FIG. 13 is a front elevation that shows a tensioning sheave of an elevator apparatus according to Embodiment 2 of the present invention and portions in a vicinity thereof.

Next, FIG. 13 is a front elevation that shows a tensioning sheave 20 of an elevator apparatus according to Embodiment 2 of the present invention and portions in a vicinity thereof. In Embodiment 2, a vibration suppressing damper 34 is disposed between a tensioning sheave frame 21 and a bottom portion of a hoistway 1. In other words, the vibration suppressing damper 34 is connected to a tensioning sheave 20 so as to have the tensioning sheave frame 21 interposed. The vibration suppressing damper 34 suppresses vertical vibration of the tensioning sheave 20 during emergency stopping of a car 9 using a hoisting machine brake 7. The rest of the configuration and operation are similar or identical to those of Embodiment 1.

During emergency brake operation using the hoisting machine brake 7, the car 9 vibrates while settling down to a constant deceleration rate as indicated by a solid line in FIG. 12, due to the influence of the suspending body 8. Because of that, there is a possibility that the maximum deceleration may approach 1 G, which is the deceleration rate during breakage of the suspending body 8.

In contrast to that, by connecting the vibration suppressing damper 34 to the tensioning sheave 20 to suppress vertical vibration of the tensioning sheave 20 due to fluctuation in the car deceleration rate, displacement of the tensioning sheave 20 at a constant deceleration rate can be evaluated by the switching operation, enabling malfunction of the tensioning sheave displacement detecting portion 24 to be more reliably prevented.

Figure 14:
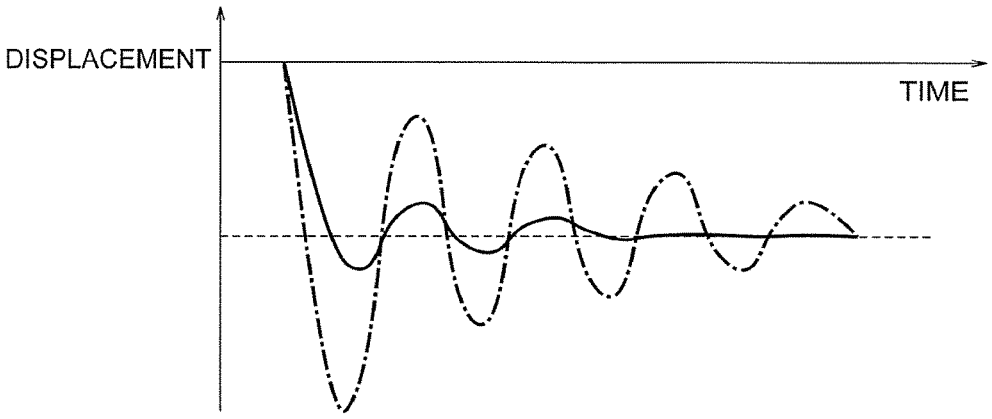
FIG. 14 is a graph that shows time variation in vertical vibration of the tensioning sheave during emergency brake operation.

FIG. 14 is a graph that shows time variation in vertical vibration of the tensioning sheave 20 during emergency brake operation, a case in which the vibration suppressing damper 34 is not used being represented by a dotted chain line, and a case in which the vibration suppressing damper 34 was used being represented by a solid line. As indicated by the solid line in FIG. 14, the influence of car vibration can be sufficiently reduced by using the vibration suppressing damper 34.

Now, if the attenuation coefficient of the vibration suppressing damper 34 is too large, then the time taken to reach the fixed value that is indicated by the broken line in FIG. 14 is longer, lengthening the time until the speed governor rope 19 is gripped when the suspending body 8 is broken. If the attenuation coefficient of the vibration suppressing damper 34 is too small, on the other hand, then it approaches the waveform of the dotted chain line in FIG. 14, and there is a possibility of malfunction. Thus, the attenuation coefficient is set such that the damping ratio is around 0.7. As indicated by the solid line in FIG. 14, delay in descent of the tensioning sheave 20 can thereby be suppressed while suppressing the amount of descent below the broken line.

Embodiment 3

Figure 15:
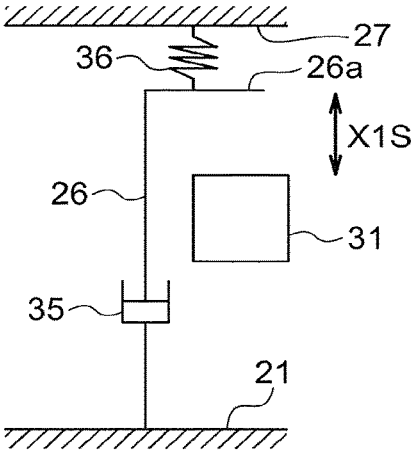
FIG. 15 is an explanatory diagram that schematically shows part of a tensioning sheave displacement detecting portion of an elevator apparatus according to Embodiment 3 of the present invention.

Next, FIG. 15 is an explanatory diagram that schematically shows part of a tensioning sheave displacement detecting portion of an elevator apparatus according to Embodiment 3 of the present invention. In Embodiment 3, an expansion and contraction absorbing damper 35 is disposed between a switch member 26 and a tensioning sheave frame 21 and a tensioning sheave 20. A switch member supporting spring 36 is also connected between the switch member 26 and a rail holding member 27.

The expansion and contraction absorbing damper 35 absorbs vertical displacement of the tensioning sheave 20 due to expansion and contraction of a speed governor rope 19 during normal conditions, not when a suspending body 8 is broken, by expanding and contracting. The switch member supporting spring 36 holds the position of the switch member 26 relative to a rope gripping mechanism 25 in opposition to the expansion and contraction of the expansion and contraction absorbing damper 35. The rest of the configuration and operation are similar or identical to those of Embodiment 1 or 2.

Stretching occurs in the speed governor rope 19 due to aging. The speed governor rope 19 also expands and contracts due to temperature changes inside the hoistway 1. When the speed governor rope 19 stretches due to aging, for example, the position of the tensioning sheave 20 becomes lower, making spacing between the switch member 26 and the wedge 31 narrower.

In answer to that, in Embodiment 3, the expansion and contraction absorbing damper 35 is connected to the switch member 26 in series, and the switch member 26 is also supported by the switch member supporting spring 36, which has low rigidity.

In such a construction, the expansion and contraction absorbing damper 35 accommodates the expansion and contraction of the suspending body 8 by expanding and contracting in response, without functioning as a resistance force. Here, the distance between the switch member 26 and the wedge 31 does not change because the switch member 26 is supported by the switch member supporting spring 36.

When the suspending body 8 is broken, on the other hand, the expansion and contraction absorbing damper 35 operates almost as a rigid body because the tensioning sheave 20 moves faster vertically. Because of that, the switch member 26 operates normally, and the speed governor rope 19 is gripped by the rope gripping mechanism 25 at a stage when the tensioning sheave 20 is displaced by a set distance. Furthermore, the rigidity of the switch member supporting spring 36 does not affect the operation of the switch member 26 because it is sufficiently low.

Now, the equation of motion of the switch member 26, when derived using y as the displacement of the switch member 26, is given by the following expression:

$$m\ddot{y}+c\dot{y}+ky=0 \tag{4}$$

Here, m represents the mass of the switch member 26, k the switch member supporting spring 36, and c the expansion and contraction absorbing damper 35. Because the expansion and contraction absorbing damper 35 maintains the position of the switch member 26 by slow movement, the inertial term in the first item on the left-hand side of Expression (4) can be ignored. Because of that, the movement of the switch member 26 can be represented by the following expression:

$$c\dot{y}+=0\rightarrow y=Ae^{-(k/c)t}=Ae^{-t/\tau} \tag{5}$$

Here, $\tau=c/k$ is a time constant, and represents the time taken to decrease from an initial value A to thirty-seven percent. If a large attenuation coefficient c is set as $\tau$, so as to take from tens of minutes to several hours, then stretching of the suspending body 8 can be tracked slowly, and the switch member 26 and the tensioning sheave 20 can be moved together when the suspending body 8 is broken.

In an elevator apparatus of this kind, because an expansion and contraction absorbing damper 35 and a switch member supporting spring 36 are used, breakage of the suspending body 8 can be detected more reliably to activate the safety device 15, while accommodating expansion and contraction of the speed governor rope 19 during normal operation.

Embodiment 4

Figure 16:
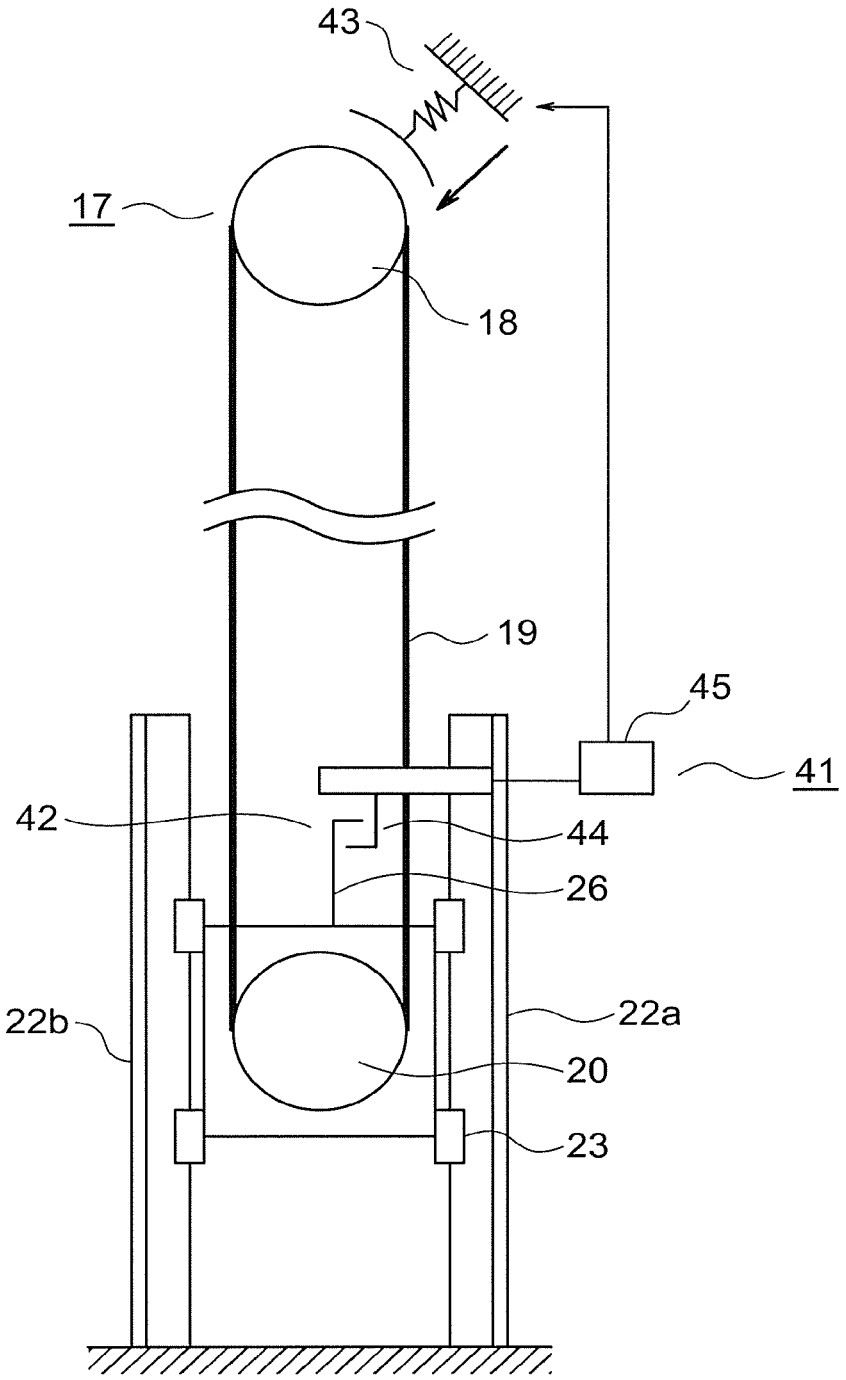
FIG. 16 is a configuration diagram that shows a tensioning sheave displacement detecting portion of an elevator apparatus according to Embodiment 4 of the present invention.

Next, FIG. 16 is a configuration diagram that shows a tensioning sheave displacement detecting portion of an elevator apparatus according to Embodiment 4 of the present invention. A tensioning sheave displacement detecting portion 41 according to Embodiment 4 has: a signal generating portion 42 that is activated by downward displacement of a tensioning sheave 20 that accompanies dropping of a car 9 due breakage of a suspending body 8 to output an electrical activating command signal; and a rope brake 43 that functions as an emergency safety activating portion that activates a safety device 15 in response to the activating command signal from the signal generating portion 42.

The signal generating portion 42 has: a switch member 26 that is similar or identical to that of Embodiment 1; a contact portion 44 that is fixed relative to a first tensioning sheave rail 22*a*; and a contact signal processing portion 45 that is connected to the contact portion 44. When the switch member 26 contacts the contact portion 44 due to downward displacement of the tensioning sheave 20, the activating command signal is outputted from the contact signal processing portion 45.

The rope brake 43 is disposed on a speed governor 17. The activating command signal from the contact signal processing portion 45 is inputted into the rope brake 43. The rope brake 43 grips the speed governor rope 19 to stop the movement of the speed governor rope 19 when the activating command signal from the contact signal processing portion 45 is received. The rest of the configuration and operation are similar or identical to those of Embodiment 1.

In an elevator apparatus of this kind, because the safety device 15 is activated using an electrical activating command signal, mechanical operating mechanisms can be omitted, enabling the construction to be simplified.

Moreover, in Embodiment 4, a rope brake 43 is shown as the emergency safety activating portion, but the emergency safety activating portion is not limited to this, and may be an actuator that drives a rope catch of an existing speed governor 17, or an actuator that is mounted directly to the safety device 15 to activate the safety device 15, for example.

Furthermore, the vibration suppressing damper 34 according to Embodiment 2 may be connected to the tensioning sheave 20 according to Embodiment 4.

In addition, the expansion and contraction absorbing damper 35 and the switch member supporting spring 36 according to Embodiment 3 may be connected to the switch member 26 according to Embodiment 4.

Furthermore, in the above examples, breakage of the suspending body 8 is detected by displacement of the tensioning sheave 20 onto which the speed governor rope 19 is wound, but a rope may be installed separately from the speed governor rope 19 in a loop inside the hoistway 1, that rope connected to a car, and breakage of the suspending body 8 detected from displacement of a tensioning sheave onto which a lower end of that rope is wound.

In the above examples, the safety device 15 is mounted to a lower portion of the car 9, but may be mounted to an upper portion, or may be mounted both top and bottom.

In addition, a car buffer may be mounted to a lower portion of the car.

Furthermore, the overall elevator apparatus equipment layout and roping method, etc., are not limited to the example in FIG. 1. The present invention can also be applied to two-to-one (2:1) roping elevator apparatuses, for example. Furthermore, the position and number of hoisting machines, for example, are also not limited to the example in FIG. 1.

The present invention can be applied to various types of elevator apparatus, such as elevator apparatuses that have no machine room, double-deck elevators, or single-shaft multi-car elevators, for example.

The invention claimed is:

1. An elevator apparatus comprising:

a car that ascends and descends inside a hoistway;

a suspending body that suspends the car;

a hoisting machine that raises and lowers the car;

a safety device that is mounted to the car, and that makes the car perform emergency stopping;

a car buffer that alleviates mechanical shock from a collision of the car into a bottom portion of the hoistway;

a rope that is installed in a loop inside the hoistway, and that is connected to the car;

a tensioning sheave that is disposed in a lower portion of the hoistway, and around which the rope is wound; and a tensioning sheave displacement detecting portion that detects displacement of the tensioning sheave that accompanies dropping of the car due to a breakage of the suspending body, and that activates the safety device.

2. The elevator apparatus according to claim 1, further comprising a speed governor that includes a speed governor sheave, and that monitors for overspeed traveling of the car, the rope being a speed governor rope that is wound around the speed governor sheave, and that is connected to the safety device.

3. The elevator apparatus according to claim 1, wherein the tensioning sheave displacement detecting portion includes:

a rope gripping mechanism that is fixed inside the hoistway; and a switch member that is connected to the tensioning sheave, the switch member is configured to be displaced downward and operate the rope gripping mechanism due to a downward displacement of the tensioning sheave, wherein the rope gripping mechanism grips the rope to activate the safety device when the switch member is displaced downward.

4. The elevator apparatus according to claim 3, wherein:

an expansion and contraction absorbing damper that absorbs vertical displacement of the tensioning sheave due to expansion and contraction of the speed governor rope by expanding and contracting is disposed between the switch member and the tensioning sheave; and a switch member supporting spring that holds a position of the switch member relative to the rope gripping mechanism in opposition to expansion and contraction of the expansion and contraction absorbing damper is disposed between the switch member and the rope gripping mechanism.

5. The elevator apparatus according to claim 1, wherein the tensioning sheave displacement detecting portion includes:

a signal generating portion that is activated by downward displacement of the tensioning sheave that accompanies dropping of the car due breakage of the suspending body to output an electrical activating command signal; and an emergency safety activating portion that activates the safety device in response to the activating command signal from the signal generating portion.

6. The elevator apparatus according to claim 1, wherein:

a hoisting machine brake is disposed on the hoisting machine; and a vibration suppressing damper that suppresses vertical vibration of the tensioning sheave during emergency stopping of the car using the hoisting machine brake is connected to the tensioning sheave.

* * * * *